US011062820B2

(12) United States Patent
Omura et al.

(10) Patent No.: US 11,062,820 B2
(45) Date of Patent: Jul. 13, 2021

(54) EXTRUDED FLEXIBLE FLAT CABLE AND WIRE HARNESS

(71) Applicant: YAZAKI CORPORATION, Tokyo (JP)

(72) Inventors: Takeyuki Omura, Susono (JP); Hiroki Kondo, Susono (JP); Yutaka Handa, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/005,303

(22) Filed: Aug. 27, 2020

(65) Prior Publication Data

US 2021/0065928 A1 Mar. 4, 2021

(30) Foreign Application Priority Data

Aug. 30, 2019 (JP) ..... JP2019-157727

(51) Int. Cl.
*H01B 7/08* (2006.01)
*H01B 7/02* (2006.01)
*H01B 7/00* (2006.01)

(52) U.S. Cl.
CPC ..... *H01B 7/0823* (2013.01); *H01B 7/0045* (2013.01); *H01B 7/0275* (2013.01)

(58) Field of Classification Search
CPC ..... H01B 7/0018; H01B 7/0045; H01B 7/02; H01B 7/0216; H01B 7/0275; H01B 7/08; H01B 7/0828; H01B 7/0823; H01B 7/0869
USPC ..... 174/110 R, 110 SR, 113 R, 117 R, 117 F, 174/117 FF
See application file for complete search history.

(56) References Cited

U.S. PATENT DOCUMENTS

| | | | | |
|---|---|---|---|---|
| 10,074,458 | B2 * | 9/2018 | Kim | H01B 3/421 |
| 2003/0019659 | A1 * | 1/2003 | Yamanobe | H05K 1/028 174/117 FF |
| 2013/0000950 | A1 | 1/2013 | Yamada et al. | |
| 2017/0148544 | A1 | 5/2017 | Yamada et al. | |

FOREIGN PATENT DOCUMENTS

| | | | |
|---|---|---|---|
| JP | 5-325683 | A | 12/1993 |
| JP | 2011-192457 | A | 9/2011 |

* cited by examiner

*Primary Examiner* — William H. Mayo, III
(74) *Attorney, Agent, or Firm* — Kenealy Vaidya LLP

(57) ABSTRACT

An extruded flexible flat cable includes conductors arranged side by side in a width direction of the extruded flexible flat cable. The conductors are spaced away from each other at a regular interval and an insulator is provided around the conductors by extrusion molding. A portion of the insulator located between the conductors, the portion having been sampled after the extruded flexible flat cable is subjected to a slide bending test, has a tensile strength being equal to or greater than 47.2 MPa. The portion has a percentage elongation being equal to or greater than 50/(0.5+2R), where R is a bend radius [mm] at which the extruded flexible flat cable is bent in the slide bending test.

6 Claims, 9 Drawing Sheets

FIG. 6

| | | (1) | (2) | (3) | (4) |
|---|---|---|---|---|---|
| MANUFACTURING CONDITIONS | RESIN TEMPERATURE(°C) | 225 | 252 | 252 | 252 |
| | TIME UNTIL WATER COOLING (SEC.) | 0.3 | 0.3 | 1.3 | 2.3 |
| RESULTS | NUMBER OF SLIDE BENDINGS | 70,252 (61,838～74,725) | 124,946 (117,188～130,602) | 607,288 (309,536～944,370) | 591,352 (467,068～723,192) |
| | MAXIMUM TENSILE STRENGTH [MPa] | 42.8 (39.4～45.8) | 51.2 (47.2～53.9) | 51.9 (49.0～53.4) | 55.1 (53.5～58.2) |
| | PERCENTAGE ELONGATION (%) | 552 (514～602) | 754 (659～895) | 788 (659～993) | 753 663～846) |

EXTRUDED FLEXIBLE FLAT CABLE AND WIRE HARNESS

CROSS-REFERENCE TO RELATED APPLICATION

The present application claims priority to Japanese Patent Application No. 2019-157727 filed on Aug. 30, 2019, the entire content of which is incorporated herein by reference.

TECHNICAL FIELD

The present invention relates to an extruded flexible flat cable including conductors arranged side by side at a regular interval and an insulator provided around the conductors by extrusion molding. The present invention also relates to a wire harness including the extruded flexible flat cable.

BACKGROUND

A related art flat cable is of a laminate type in which a plurality of conductors separated from each other and arranged in parallel are sandwiched by insulating resin films (see, for example, JPH05-325683A). As the resin films, a polyethylene terephthalate resin (PET) is used, and the resin films are manufactured by being bonded via an adhesive layer made of a thermoplastic resin or the like, and then by being pressed with a heat roll in the form of thermocompression bonding. For the flat cable obtained by the above-described method, the thermocompression bonding with the heat roll is carried out after necessary materials are provided and laminated. In order to ensure a sufficient adhesive force at the time of thermocompression bonding, the speed of a production line cannot be made very fast. Therefore, the productivity of the flat cable is reduced, and the manufacturing cost is increased.

In order to reduce the manufacturing cost, it is conceivable to adopt an extruded flexible flat cable in which a plurality of conductors arranged in parallel (arranged side by side at a regular interval) are coated by an extruded insulation resin. However, the adhesive property of the extruded flexible flat cable, between the conductors and the insulator, is lower than the case of laminating the resin films. Therefore, the extruded flexible flat cable is relatively more fragile against external stress.

The extruded flexible flat cable of the related art is provided by extrusion molding using a polybutylene terephthalate resin (PBT), and can provide an extruded flexible flat cable having excellent processability, bending endurance, adhesiveness, and heat resistance. The extruded flexible flat cable of the related art has good adhesion property between the conductors and the insulator (see, for example, JP2011-192457A).

The polybutylene terephthalate resin, used as the resin material in the extruded flexible flat cable of the related art, is a crystalline resin. Even the same resin has various degrees of crystallinity depending on cooling conditions and resin melting conditions during extrusion molding. For example, when the speed of cooling is high, crystallization is suppressed, but if crystallization is excessively advanced, a flexural modulus increases. As a result, it is more likely that a crack occurs in the insulator at the time of bending.

SUMMARY

The present invention provides an extruded flexible flat cable having good bending characteristics. Further, the present invention provides a wire harness including the extruded flexible flat cable.

According to an illustrative aspect of the present invention, a wire harness includes an extruded flexible flat cable and an electrical connection portion provided on the extruded flexible flat cable. The extruded flexible flat cable includes conductors arranged side by side in a width direction of the extruded flexible flat cable, the conductors being spaced away from each other at a regular interval and an insulator provided around the conductors by extrusion molding. A portion of the insulator located between the conductors, the portion having been sampled after the extruded flexible flat cable is subjected to a slide bending test, has a tensile strength being equal to or greater than 47.2 MPa. The portion has a percentage elongation being equal to or greater than 50/(0.5+2R), R being a bend radius [mm] at which the extruded flexible flat cable is bent in the slide bending test.

Other aspects and advantages of the invention will be apparent from the following description, the drawings and the claims.

BRIEF DESCRIPTION OF THE DRAWINGS

FIGS. 1A and 1B show an embodiment of an extruded flexible flat cable and a wire harness according to the present invention, in which FIG. 1A is a configuration of the wire harness, and in which FIG. 1B is a cross-sectional view taken along line A-A of the extruded flexible flat cable;

FIGS. 4A and 4B are diagrams showing a bend radius and a percentage elongation, in which FIG. 4A describes a bend radius R, and in which FIG. 4B shows a range of conditions under which the extruded flexible flat cable is not a defective product;

FIG. 6 is a diagram showing results of the slide bending test of the extruded flexible flat cable under varied manufacturing conditions of an insulator;

DETAILED DESCRIPTION

Figure 1B:
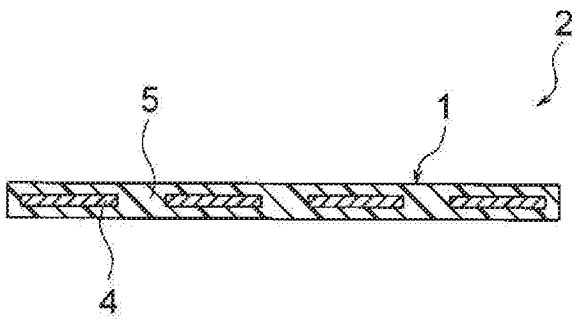
Figure 1A:
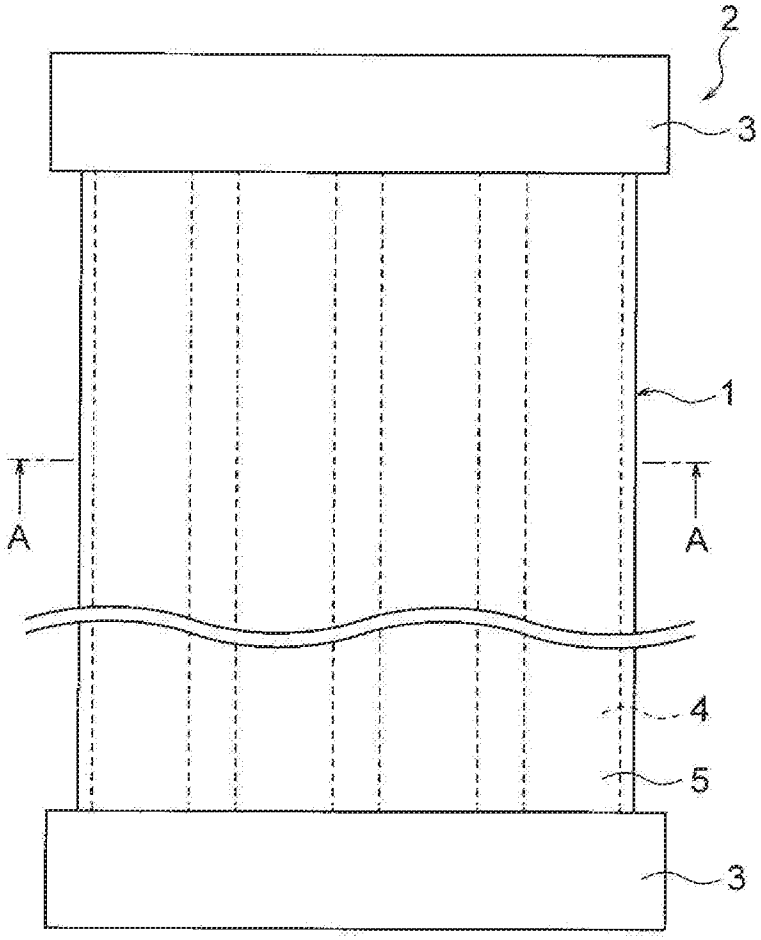
Figure 2:
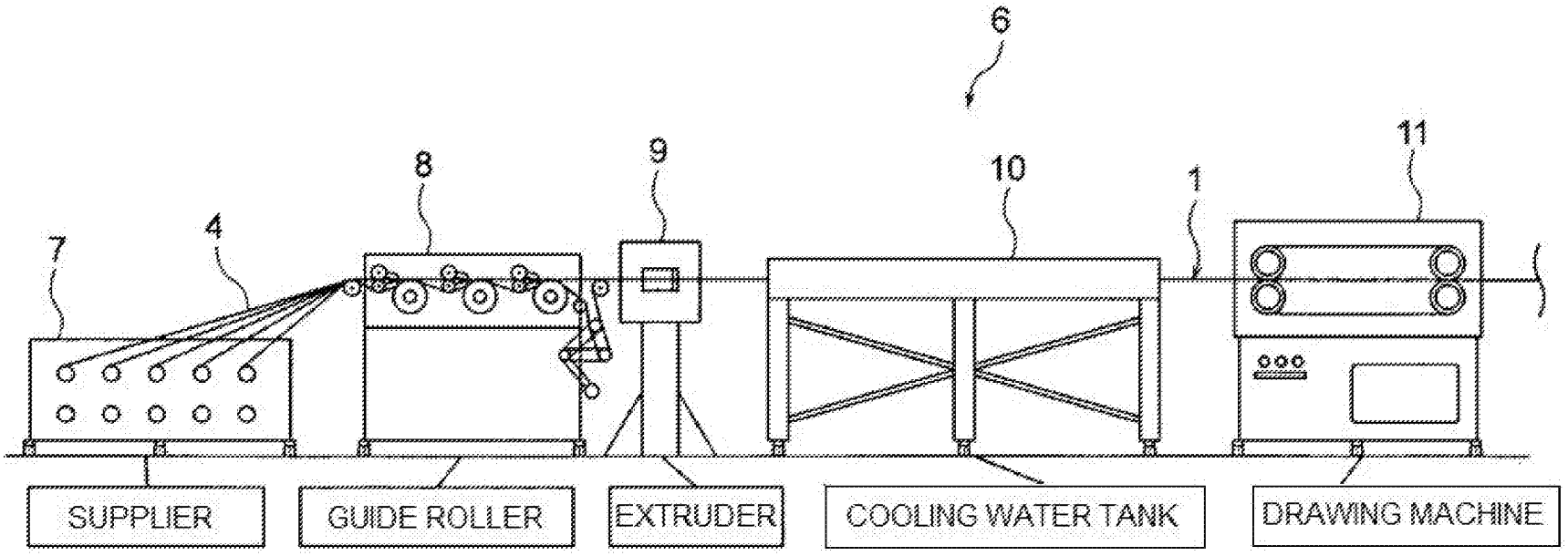
FIG. 2 is a diagram showing an apparatus for manufacturing the extruded flexible flat cable.
Figure 3:
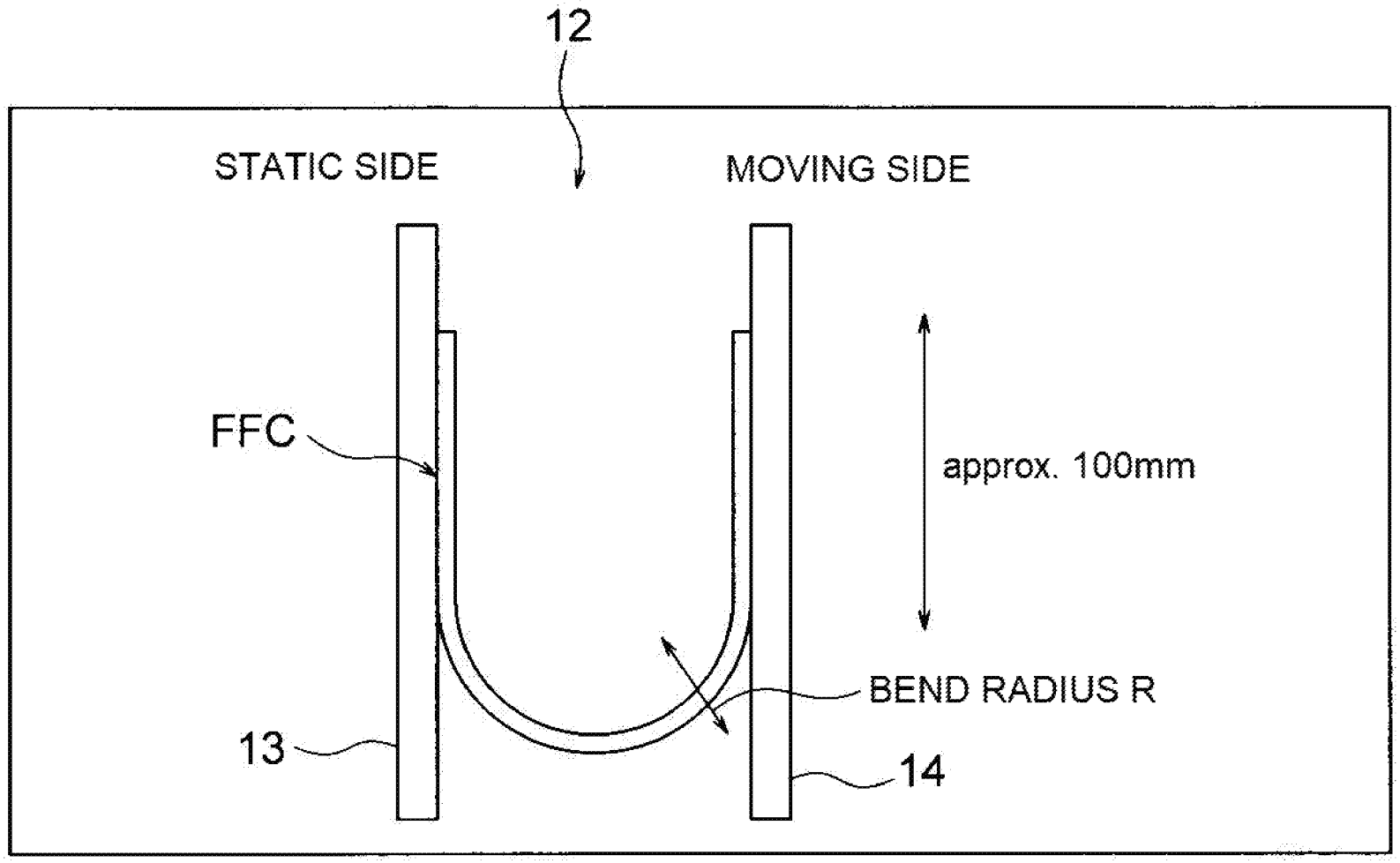
FIG. 3 is a diagram of a test apparatus for a slide bending test.
Figure 4B:
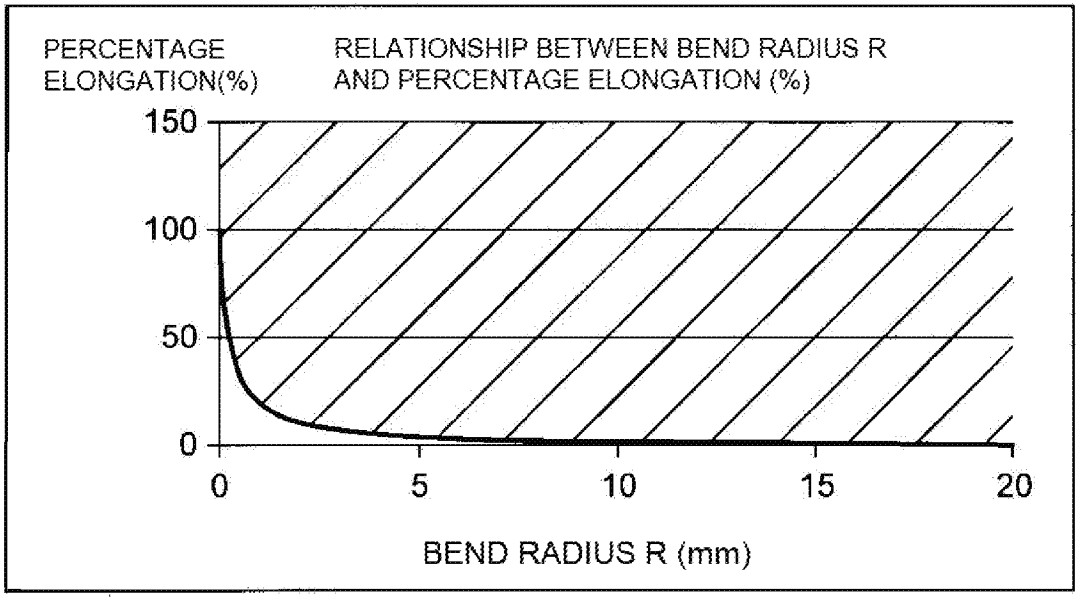
Figure 4A:
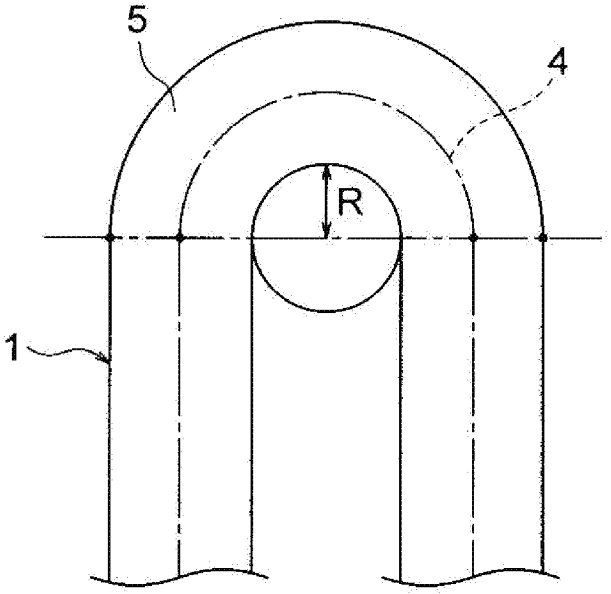
Figure 5:
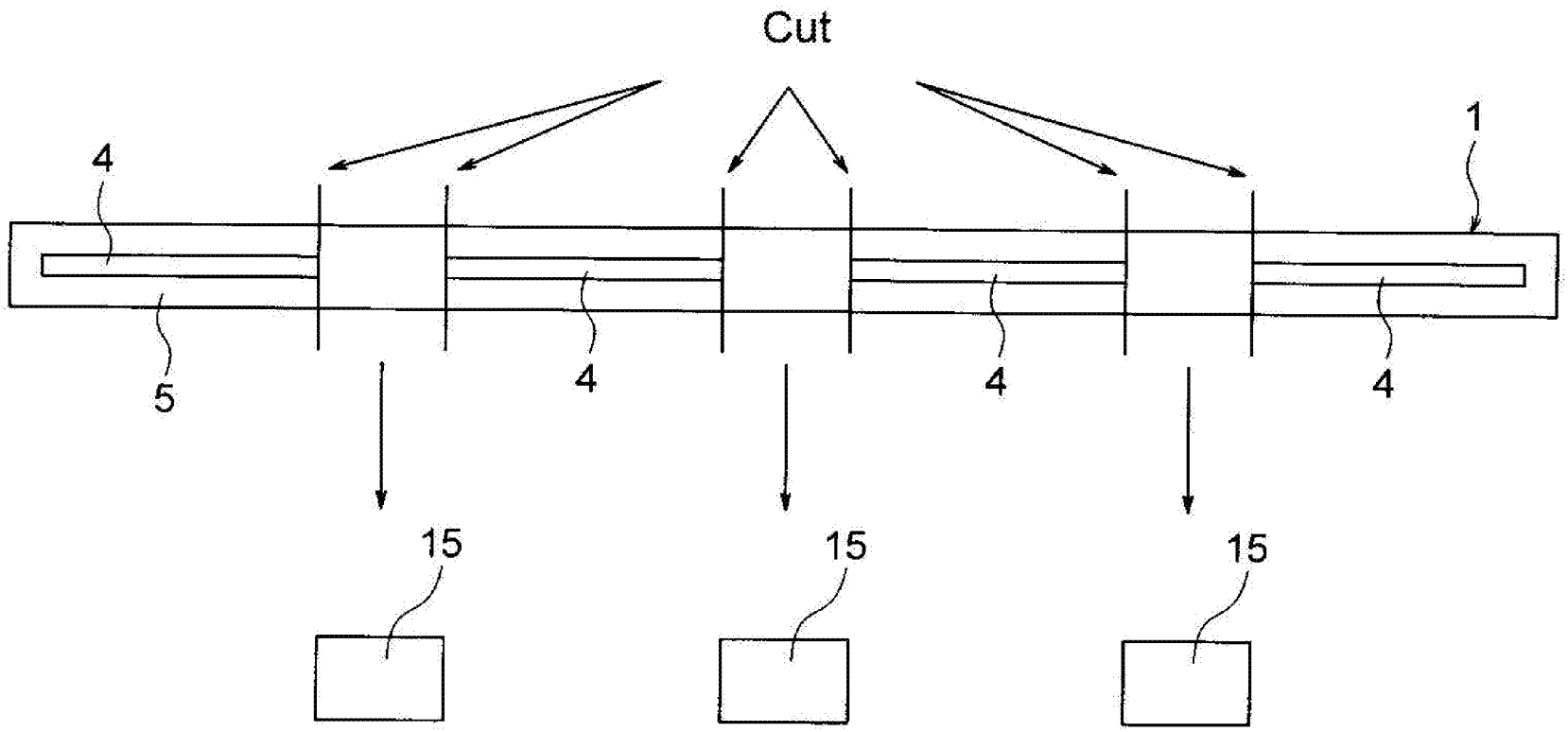
FIG. 5 is a diagram showing formation of insulator samples.
Figure 7:
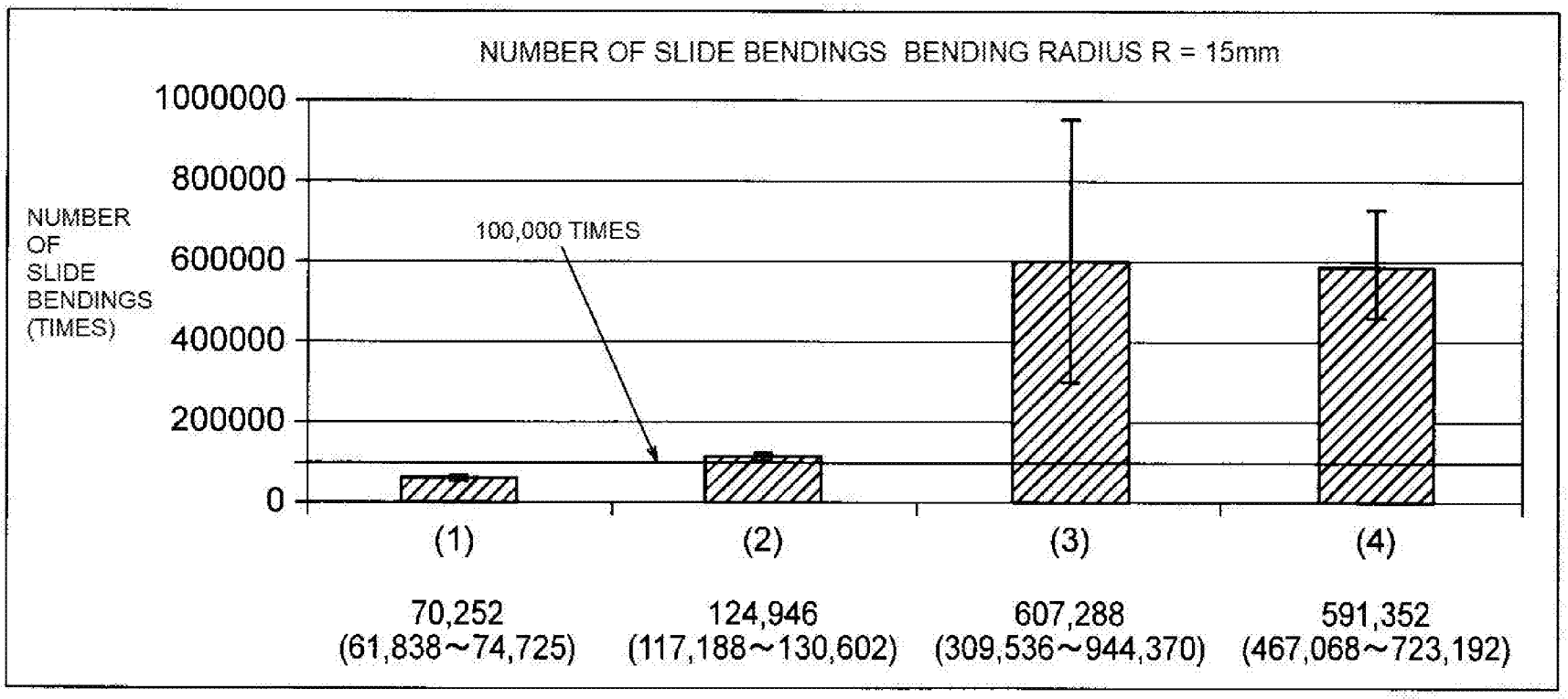
FIG. 7 is a diagram showing the number of times of slide bending of the extruded flexible flat cable in the slide bending test.
Figure 8:
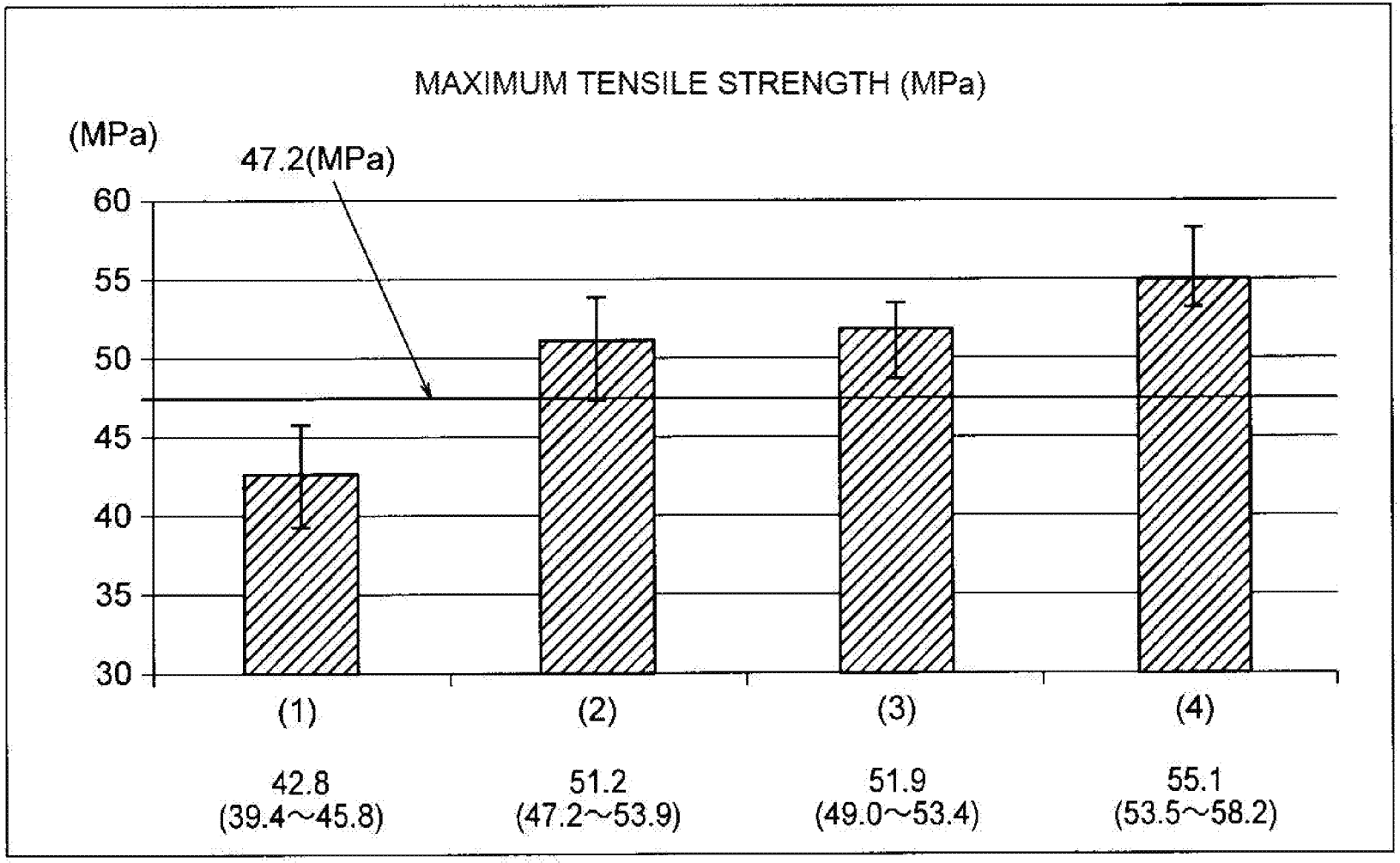
FIG. 8 is a diagram showing a tensile strength of the insulator.
Figure 9:
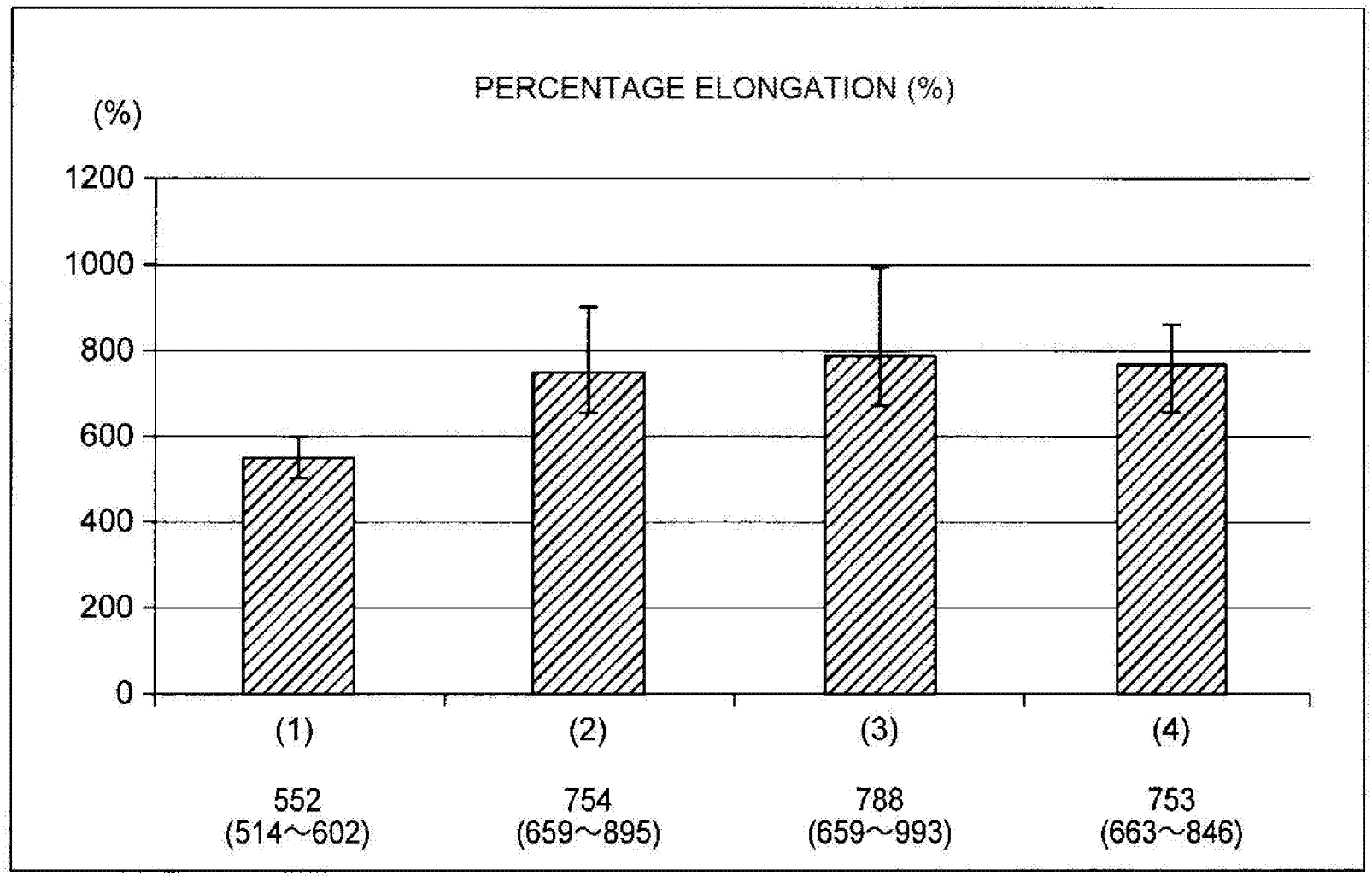
FIG. 9 is a diagram showing the percentage elongation of the insulator.

Embodiments will be described below with reference to the drawings. FIGS. 1A and 1B shows an embodiment of an extruded flexible flat cable and a wire harness of the present invention. FIG. 2 is a diagram showing an apparatus for manufacturing the extruded flexible flat cable. FIG. 3 is a diagram of a test apparatus for a slide bending test. FIGS. 4A and 4B are diagrams showing a bend radius and a percentage elongation. FIG. 5 is a diagram showing formation of insulator samples. FIG. 6 is a diagram showing manufacturing conditions of an insulator and evaluation results of the slide bending test. FIG. 7 is a diagram showing the number of times of slide bending. FIG. 8 is a diagram showing a tensile strength. FIG. 9 is a diagram showing the percentage elongation.

An extruded flexible flat cable 1 shown in FIG. 1 is used, for example, as a part of a wire harness 2 arranged in an automobile. The wire harness 2 includes the extruded flexible flat cable 1 and further includes connectors 3 (electrical connection portions) respectively provided on both ends of the extruded flexible flat cable 1. The connectors 3 are provided by attaching a terminal fitting made of metal to a connector housing having an insulating property, the terminal fitting being attached to conductors 4, which will be described later, the conductor 4 being exposed by peeling off an insulating material at an end of the extruded flexible flat cable 1.

The extruded flexible flat cable 1 is an elongated, substantially band-shaped conductive path, and includes a plurality of conductors 4 and an insulator 5 covering the plurality of conductors 4. The plurality of conductors 4 are arranged side by side in a width direction of the extruded flexible flat cable at a regular interval. The number of conductors 4 in this embodiment is four (this number is just an example). All the four conductors 4 are the same conductors. As the conductor 4, a metal thin plate having a strip-like (tape-like) shape made of copper or copper alloy being electrically conductive is used after being cut at a necessary length in a longitudinal direction thereof. A cross-sectional shape of the conductor 4 is rectangular, and a width and a thickness thereof are appropriately set according to desired cross-sectional areas. The conductors 4 are flexible.

The insulator 5 is provided around the four conductors 4 by extrusion molding. The insulator 5 is provided so as to fill a space between the four conductors 4 and to surround the four conductors 4. In addition, the insulator 5 has a rectangular shape in cross section and has a strip shape (tape shape) wider than the width of each of the conductors 4. The insulator 5 is provided by melting a resin material having insulating properties and extruding the melted resin material toward the four conductors 4. The insulator 5 is flexible. That is, the insulator 5 has flexibility such that the insulator 5 can be folded back in a longitudinal direction with the conductors 4 being covered by the insulator 5. The resin material of the insulator 5 may be any one of the followings: a polybutylene terephthalate resin (PBT); a fluororesin; a vinyl chloride resin (PVC); a polyphenylene sulfide resin (PPS); a polyethylene resin (PE); a polyethylene terephthalate resin (PET): and a polypropylene resin (PP). A polybutylene terephthalate resin (PBT) is preferable.

A detailed description of the polybutylene terephthalate resin (PBT) is omitted here. The extruded flexible flat cable of the related art uses extrusion molded body of the polybutylene terephthalate resin (PBT), and provides an extruded flexible flat cable having excellent processability, bending resistance, adhesiveness, and heat resistance. The present invention provides an extruded flexible flat cable 1 having better bending characteristics than that disclosed in the related art.

The extruded flexible flat cable 1 of FIG. 1 is manufactured with a manufacturing apparatus 6 shown in FIG. 2. The manufacturing apparatus 6 includes, in sequence from an upstream of the manufacturing process, a supplier 7 for supplying the conductors 4, a guide roller 8 for straightening the conductors 4, an extruder 9 for forming the insulator 5 by extruding molten resin toward the conductors 4, a cooling water tank 10 for cooling the extruded insulator 5 having high temperature, and a drawing machine 11 for drawing the extruded flexible flat cable 1, for example. A time required from the extruder 9 to the cooling water tank 10 will be hereinafter referred to as "lime until water cooling [second]".

The above-described manufacturing apparatus 6 of FIG. 2 is common one, and thus a detailed description thereof is omitted. Even when the same resin material is used, if the manufacturing conditions change, such as a melting temperature of the resin material, a manufacturing line speed, and an air gap (a distance between the extruder 9 and the cooling water tank 10), characteristics of the extruded flexible flat cable 1 at a time of slide bending van greatly. In other words, these manufacturing conditions changes the crystallinity of the resin (the insulator 5) and the probability and the degree of fatigue fracture that may occur in the conductors 4 when the extruded flexible flat cable 1 is bent also changes. Therefore, the present invention aims to make a portion of the insulator 5 located between the conductors 4, the portion having been sampled after the extruded flexible flat cable is subjected to a slide bending test, has a tensile strength being equal to or greater than 47.2 MPa in which the portion has a percentage elongation being equal to or greater than 50/(0.5+2R), R being a bend radius [mm] at which the extruded flexible flat cable is bent in the slide bending test, thereby attempting to obtain an extruded flexible flat cable that has improved slide bending characteristics, i.e., attempting to obtain an extruded flexible flat cable that has improved bending characteristics. The present invention provides an extruded flexible flat cable 1 that has required quality for being used at least for an automobile (the number of times of slide bending of the extruded flexible flat cable that the extruded flexible flat cable should endure being 100,000 times or more at bend radius R at the time of the slide bending test being 15 [mm])). The reason why it is desirable to have the insulator 5 that can satisfy the above mentioned conditions will be explained with a description of the slide bending test and the results thereof.

The slide bending test is carried out with the extruded flexible flat cable 1 set to a test apparatus 12 as shown in FIG. 3 at room temperature of 23° C. One end side of the extruded flexible flat cable 1 is fixed to a static plate 13 of the test apparatus 12, and the other end side thereof is fixed to a moving plate 14. The static plate 13 remains static during the test, and the moving plate 14 moves for 100 mm in directions of an arrow of the drawing (the extruded flexible flat cable 1 moves approximately 100 mm). In the present embodiment, the extruded flexible flat cable 1 is set between the static plate 13 and the moving plate 14 with the bend radius R of 15 [mm]. The moving plate 14 is adjusted such that the test is carried out at speed 60 cycles/min. The minimum number of times of slide bending that the extruded flexible flat cable should endure is 100,000 times. Whether the extruded flexible flat cable passes or fails the test is determined by increase rate of conductor resistivity of the extruded flexible cable 1 comparing conductor resistivity of the extruded flexible cable 1 before and after the slide bending test. More specifically, when conductor resistivity of the extruded flexible flat cable 1 after the slide bending test is greater than conductor resistivity of the extruded flexible flat cable 1 before the slide bending test by 10% or less, the extruded flexible flat cable 1 is considered to have passed the test.

In FIG. 4, the slide bending test is carried out with the extruded flexible flat cable 1 being bent at a certain bend radius R as shown in FIG. 4A, and if the insulator 5 does not extend beyond a strain amount occurring in the extruded flexible flat cable 1 upon bending, cracking may occur in the insulator 5 upon bending. When the bend radius R changes, the percentage elongation [%] that the insulator 5 needs to have changes as well. Therefore, it is necessary to take a value of the bend radius R into account for calculation of the percentage elongation [%] and the percentage elongation [%] should be equal to or greater than 50/(0.5+2R). A relationship between the bend radius R and the percentage elongation [%] is shown in FIG. 4B, in which a hatched range shows a range of good product (a non-defective product range). It is necessary to employ an extruded flexible flat cable 1 that falls into the non-defective range.

To measure the tensile strength [MPa] and the percentage elongation [%], an insulator sample 15, which is a portion of the insulator 5 between the conductors 4, is extracted as shown in FIG. 5. The insulator sample 15 is provided by cutting a portion of the insulator 5 located between the conductors 4 in the extruded flexible flat cable 1 after the test. The insulator sample 15 is obtained by cutting the portion out of the insulator 5 by about 150 mm (a length required for a tensile test) in the longitudinal direction. The distance between the conductors 4 at the regular interval upon manufacture (before the test) is hereinafter referred to as a "standard interval".

The tensile strength [MPa] (maximum tensile strength) is determined as follows. That is, the tensile strength is calculated by a relationship of tensile strength [MPa]=maximum load [N]/insulator cross-sectional area [mm]. The maximum load [N] is a maximum load [N] incurred by the insulator sample 15 with both ends of the insulator sample 15 in the longitudinal direction being attached to chucks and pulled at a tensile speed of 100 mm/min. The insulator cross-sectional area [mm-] is a cross-sectional area of the insulator sample 15.

The percentage elongation [%] is determined as follows. That is, the percentage elongation is obtained by determining an elongation taking an actual measured value into account, and converting the obtained number to a percent. Specifically, the percentage elongation is calculated by a relationship of percentage elongation [%]=(actual measured value of elongation [mm]−standard interval [mm])/standard interval [mm]*100.

In FIG. 6, the manufacturing conditions of the insulator 5 shown in (1) are that temperature of resin [° C.] is 225, and time until water cooling [second] is 0.3. Under such manufacturing conditions, an average number of times of slide bending that the extruded flexible flat cable 1 endured was 70,252 (61,838 to 74,725), an average maximum tensile strength [MPa] was 42.8 (39.4 to 45.8), and an average percentage elongation [%] was 552 (514 to 602). Under the conditions of (1), the aimed number of slide bending, 100,000 times, was not achieved.

The manufacturing conditions of the insulator 5 shown in (2) are that temperature of resin [° C.] is 252, and time until water cooling [second] is 0.3. Under such manufacturing conditions, the average number of times of slide bending that the extruded flexible flat cable 1 endured was 124,946 (117,188 to 130,602), the average maximum tensile strength [MPa] was 51.2 (47.2 to 53.9), and the average percentage elongation [%] was 754 (659 to 895). Under the conditions of (2), the aimed number of slide bending, 100,000 times, was achieved.

The manufacturing conditions of the insulator 5 shown in (3) are that temperature of resin [° C.] is 252, and time until water cooling [second] is 1.3. Under such manufacturing conditions, the average number of times of slide bending that the extruded flexible flat cable 1 endured was 607,288 (309,536 to 944,370), the average maximum tensile strength [MPa] was 51.9 (49.0 to 53.4), and the average percentage elongation [%] was 788 (659 to 993). Under the conditions of (3), the aimed number of slide bending, 100,000 times, was achieved, with results by far greater than 100,000 times.

The manufacturing conditions of the insulator 5 shown in (4) are that temperature of resin [° C.] is 252, and time until water cooling [second] is 2.3. Under such manufacturing conditions, the average number of times of slide bending that the extruded flexible flat cable 1 endured was 591,352 (467,068 to 723,192), the average maximum tensile strength [MPa] 55.1 (53.5 to 58.2), and the average percentage elongation [%] was 753 (663 to 846). Under the conditions of (4), the aimed number of slide bending, 100,000 times, was achieved, with results by far greater than 100,000 times. Note that since the number of times of slide bending achieved under the conditions of (4) was smaller than under the conditions of (3), it is assumed that the factor that had influence on the decrease was time until water cooling [second]. Therefore, to further limit the manufacturing conditions of the insulator 5, an upper limit of time until water cooling [second] may be set to 2.3 [second].

FIG. 7 shows that, the aimed number of slide bending, 100,000 times can be achieved under the manufacturing conditions (2) to (4) of the insulator 5. However, since the results obtained under the conditions (2) were quite different from those of the conditions (3) and (4), it is considered that an insulator 5 that meets at least the manufacturing conditions (2) is preferable. Regarding the maximum tensile strength [MPa] shown in FIG. 8, since a minimum value of the tensile strength under the manufacturing conditions (2) is 47.2, it is considered that the insulator 5 whose insulator sample 15 has the tensile strength of at least 47.2 is preferable.

Regarding the percentage elongation [%] shown in FIG. 9, the extruded flexible flat cable 1 fall into the non-defective range under all the conditions mentioned above. Therefore, it is preferable that the insulator 5 has percentage elongation that satisfies the relationship of percentage elongation [%]≥50/(0.5+2R), to fall into the non-defective range.

To summarize the above, by forming the insulator 5 such that an insulator sample 15, which has been sampled by taking out a portion of the insulator 5 between the conductors 4 after the extruded flexible flat cable 1 has undergone the slide bending test, has a tensile strength being equal to or greater than 47.2 MPa and has percentage elongation [%] being equal to or greater than 50/(0.5+2R), R being a bend radius [mm] at which the extruded flexible flat cable 1 is bent in the slide bending test, it is possible to provide an extruded flexible flat cable 1 and a wire harness 2 that have required quality for being used for automobiles. That means, the extruded flexible flat cable 1 and the wire harness 2 still maintain satisfactory quality as a non-defective product that can endure slide bending 100,000 times or more with bend radius R 15 [mm]) during the slide bending test.

As described above with reference to FIGS. 1 to 9, according to the extruded flexible flat cable 1 and the wire harness 2 according to the embodiment of the present invention, by providing the insulator 5 that has a certain tensile strength [MPa] and percentage elongation [%], it is possible to provide the extruded flexible flat cable 1 and the wire harness 2 that can endure a large number of times of slide bending, that is, the extruded flexible flat cable and the wire harness 2 have excellent bending characteristics. The present invention shows ranges of a flexural modulus of the insulator 5 and of adhesive property between the conductors 4 and the insulator 5 in which the aimed number of times of slide bending can be achieved using the tensile strength [MPa] and the percentage elongation [%].

According to an aspect of the embodiments described above, an extruded flexible flat cable includes conductors arranged side by side in a width direction of the extruded flexible flat cable, the conductors being spaced away from each other at a regular interval and an insulator provided around the conductors by extrusion molding. A portion of the insulator located between the conductors, the portion having been sampled after the extruded flexible flat cable is subjected to a slide bending test, has a tensile strength being equal to or greater than 47.2 MPa. The portion has a percentage elongation being equal to or greater than 50/(0.5+2R), R being a bend radius [mm] at which the extruded flexible flat cable is bent in the slide bending test.

According to the extruded flexible flat cable having the above-described configuration, by forming the insulator to have a certain tensile strength and percentage elongation, it is possible to provide an extruded flexible flat cable that can endure a large number of times of slide bending, that is, the extruded flexible flat cable has excellent bending characteristics. If the tensile strength is lower than 47.2 [MPa], it is difficult to achieve the aimed number of times of slide bending, which is 100,000, and if the percentage elongation is not satisfactory, cracks may occur in the insulator upon bending.

A wire harness may include the extruded flexible flat cable and an electrical connection portion provided on the extruded flexible flat cable.

With this configuration, since the wire harness includes the extruded flexible flat cable, a better wire harness can be provided.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

What is claimed is:

1. An extruded flexible flat cable comprising:

conductors arranged side by side in a width direction of the extruded flexible flat cable, the conductors being spaced away from each other at a regular interval; and an insulator provided around the conductors by extrusion molding, wherein a portion of the insulator located between the conductors, the portion of the insulator having been sampled after the extruded flexible flat cable is subjected to a slide bending test, has a tensile strength being equal to or greater than 47.2 MPa, and wherein the portion has a percentage elongation being equal to or greater than 50/(0.5+2R), R being a bend radius [mm] at which the extruded flexible flat cable is bent in the slide bending test.

2. The extruded flexible flat cable of claim 1, wherein R is 15 mm.

3. The extruded flexible flat cable of claim 1, wherein the portion having been sampled is subjected to at least 100,000 repetitions of a slide bending test.

4. The extruded flexible flat cable of claim 1, wherein the insulator is extrusion molded at a temperature of 252 degrees Celsius and a time until water cooling of at least 0.3 seconds.

5. The extruded flexible flat cable of claim 1, wherein the slide bending test includes at least 100,000 repetitions of slide bending of the extruded flexible flat cable.

6. A wire harness comprising:

an extruded flexible flat cable and an electrical connection portion provided on the extruded flexible flat cable, wherein the extruded flexible flat cable comprising;

conductors arranged side by side in a width direction of the extruded flexible flat cable, the conductors being spaced away from each other at a regular interval; and an insulator provided around the conductors by extrusion molding, wherein a portion of the insulator located between the conductors, the portion of the insulator having been sampled after the extruded flexible flat cable is subjected to a slide bending test, has a tensile strength being equal to or greater than 47.2 MPa, and wherein the portion has a percentage elongation being equal to or greater than 50/(0.5+2R), R being a bend radius [mm] at which the extruded flexible flat cable is bent in the slide bending test.

* * * * *